US010676983B2

(12) United States Patent
Fuller et al.

(10) Patent No.: US 10,676,983 B2
(45) Date of Patent: Jun. 9, 2020

(54) FIRE UNDER GLASS DISPLAY

(71) Applicants: Mark Fuller, Sun Valley, CA (US); James Doyle, Sun Valley, CA (US); Thomas Marquet, Sun Valley, CA (US); Eric Haik, Sun Valley, CA (US)

(72) Inventors: Mark Fuller, Sun Valley, CA (US); James Doyle, Sun Valley, CA (US); Thomas Marquet, Sun Valley, CA (US); Eric Haik, Sun Valley, CA (US)

(73) Assignee: WET, Sun Valley, CA (US)

( * ) Notice: Subject to any disclaimer, the term of this patent is extended or adjusted under 35 U.S.C. 154(b) by 0 days.

(21) Appl. No.: 16/110,978

(22) Filed: Aug. 23, 2018

(65) Prior Publication Data

US 2019/0063145 A1 Feb. 28, 2019

Related U.S. Application Data

(60) Provisional application No. 62/549,372, filed on Aug. 23, 2017.

(51) Int. Cl.

| | |
|---|---|
| ***F24C 3/00*** | (2006.01) |
| ***F24B 1/19*** | (2006.01) |
| ***E06B 5/16*** | (2006.01) |
| ***F24B 1/193*** | (2006.01) |

(52) U.S. Cl.

CPC ..... *E06B 5/165* (2013.01); *F24B 1/193* (2013.01); *F24C 3/006* (2013.01)

(58) Field of Classification Search

CPC ..... A47J 37/0704; A47J 37/0718; A47J 37/0731; A47J 37/0713; A47J 37/0727; A47J 37/074; F24B 1/1808; F24B 1/181; F24C 3/006; F24C 3/004; G09F 19/22; G09F 19/228; G09F 2019/223

See application file for complete search history.

(56) References Cited

U.S. PATENT DOCUMENTS

| | | | | | |
|---|---|---|---|---|---|
| 4,127,100 | A * | 11/1978 | Baker | F24B 7/04 | 126/110 B |
| 4,258,693 | A * | 3/1981 | Baker | F24B 7/045 | 126/522 |
| 4,316,446 | A * | 2/1982 | Russo | F24B 13/004 | 126/192 |
| 4,372,286 | A * | 2/1983 | Baker | F24B 7/045 | 126/522 |
| 5,000,162 | A * | 3/1991 | Shimek | F24C 3/006 | 126/512 |
| 5,678,534 | A * | 10/1997 | Fleming | F24B 1/006 | 126/512 |
| 5,961,042 | A * | 10/1999 | Doyle | F21S 8/00 | 239/12 |
| 6,267,113 | B1 * | 7/2001 | Maust | F24B 1/1808 | 126/512 |
| 6,383,421 | B1 * | 5/2002 | Phipps | C04B 14/42 | 264/279 |

(Continued)

FOREIGN PATENT DOCUMENTS

| | | |
|---|---|---|
| EP | 2 735 792 A1 | 5/2014 |
| JP | 2005-265326 | 9/2005 |

*Primary Examiner* — Kyle J. Walraed-Sullivan

(74) *Attorney, Agent, or Firm* — Maceiko IP

(57) ABSTRACT

A fire display that may reside under a viewing window or panel. The display may include a tray or channel along which a fire ball or fire wave may travel. The display includes a gas delivery system.

20 Claims, 14 Drawing Sheets

(56) References Cited

U.S. PATENT DOCUMENTS 6,461,014 B1 * 10/2002 Lin ..... F21S 10/002 362/101
6,609,514 B1 * 8/2003 Bertolas ..... F24B 1/1808 126/519
6,769,906 B1 * 8/2004 Grove ..... F23D 14/28 126/519
6,982,649 B2 * 1/2006 Blum ..... A47L 23/22 340/572.1
7,334,360 B1 * 2/2008 Corry ..... G09F 19/12 40/428
D574,071 S * 7/2008 Dabrowski ..... D23/344
7,806,345 B2 * 10/2010 Tsunekawa ..... F24B 1/1808 126/500
9,170,017 B2 * 10/2015 Shimek ..... F23C 7/004
2001/0024773 A1 * 9/2001 Georgantas ..... F23D 14/00 431/125
2003/0039933 A1 * 2/2003 Lyons ..... C04B 28/24 431/125
2003/0113677 A1 * 6/2003 Doud ..... F23D 99/00 431/77
2003/0161145 A1 * 8/2003 Liu ..... F21S 6/001 362/161
2003/0188735 A1 * 10/2003 Yang ..... F24B 1/1808 126/519
2005/0134474 A1 * 6/2005 Kokonaski ..... G09F 9/30 340/815.4
2005/0150485 A1 * 7/2005 Barber ..... F24C 3/006 126/85 R
2006/0236996 A1 * 10/2006 Mosher, II ..... F24B 3/00 126/30
2007/0235018 A1 * 10/2007 Hills ..... F24B 1/192 126/190
2008/0216366 A1 * 9/2008 Purton ..... F24C 7/004 40/428
2008/0278408 A1 * 11/2008 Strickland ..... G09F 19/22 345/1.1
2009/0016048 A1 * 1/2009 McBrien ..... F21L 17/00 362/180
2009/0178667 A1 * 7/2009 Kline ..... F24B 1/198 126/500
2010/0236544 A1 9/2010 Hall, Jr. et al.
2010/0300428 A1 * 12/2010 Bald ..... F24B 1/08 126/501
2011/0162636 A1 * 7/2011 Gallo ..... F24B 1/207 126/523
2011/0220090 A1 * 9/2011 Atemboski ..... F24B 1/006 126/500
2012/0216796 A1 * 8/2012 Benedetti ..... F24C 3/006 126/547
2013/0084533 A1 * 4/2013 Begg ..... F23Q 25/00 431/2
2014/0008455 A1 * 1/2014 Muff ..... F23N 5/102 239/17
2014/0044423 A1 * 2/2014 Chu ..... F24H 3/0417 392/348
2014/0290643 A1 * 10/2014 Potter ..... F23C 7/004 126/512
2014/0305428 A1 10/2014 Liang
2014/0308633 A1 * 10/2014 Russell ..... G09B 19/00 434/226
2015/0184861 A1 * 7/2015 Zhu ..... F24B 7/00 126/21 A
2015/0354817 A1 * 12/2015 Fuller ..... F24H 9/0068 126/75
2016/0131394 A1 5/2016 Liang
2017/0350600 A1 * 12/2017 Jenkins ..... F24B 1/181
2018/0098382 A1 * 4/2018 Kaylor ..... F24D 15/02
2018/0111152 A1 * 4/2018 Fuller ..... B05B 12/02

* cited by examiner

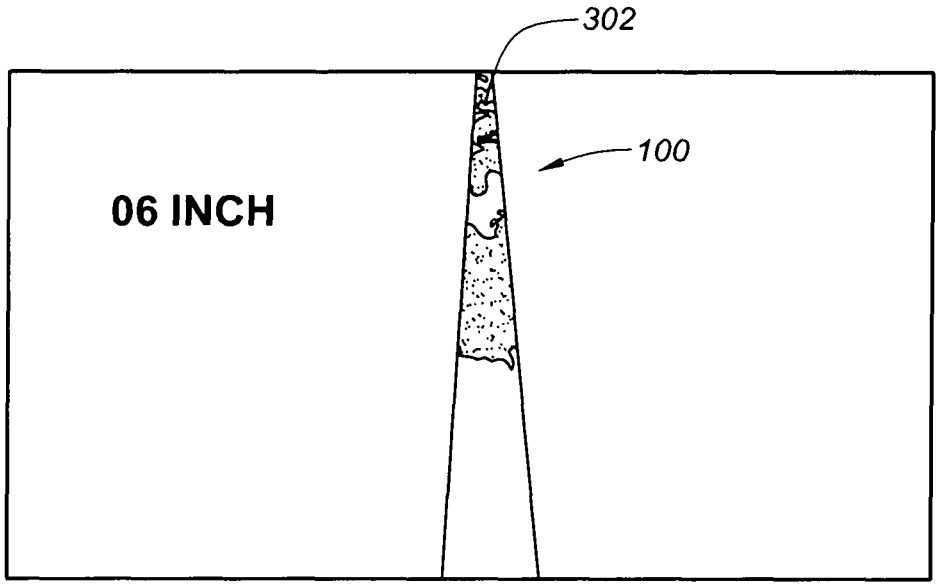
FIG. 5Gi
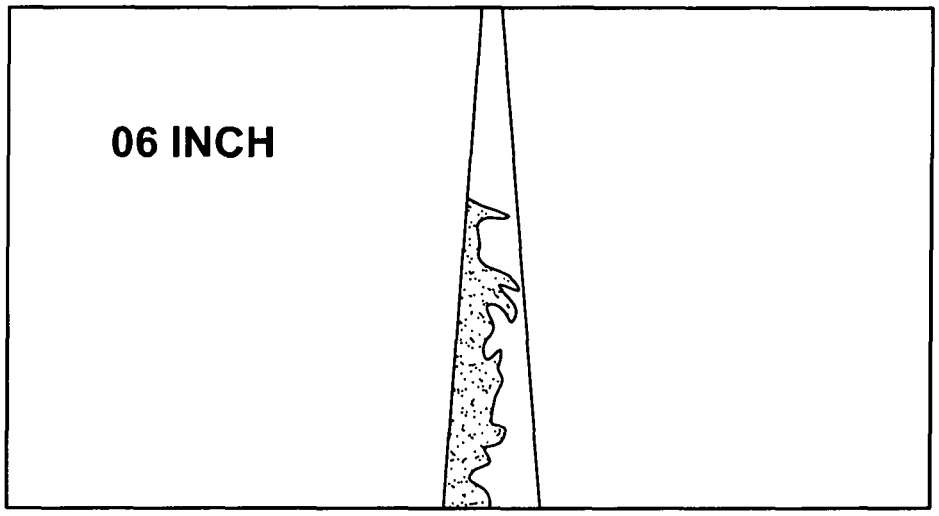
FIG. 5Gii

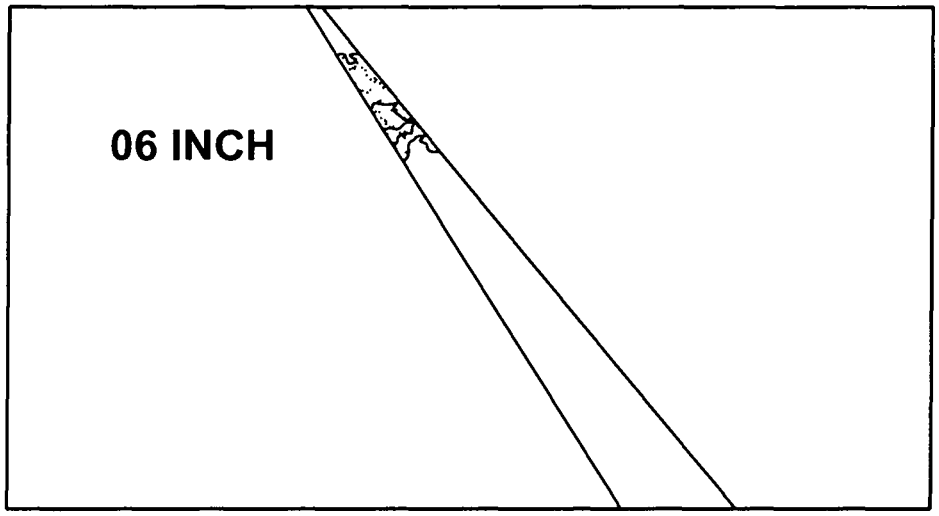
FIG. 5Giii

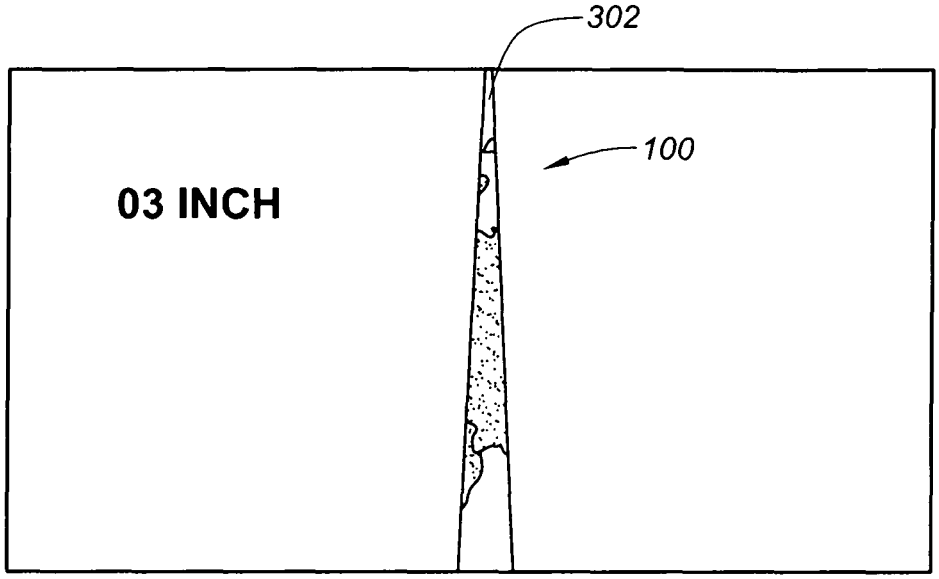
FIG. 5Hi
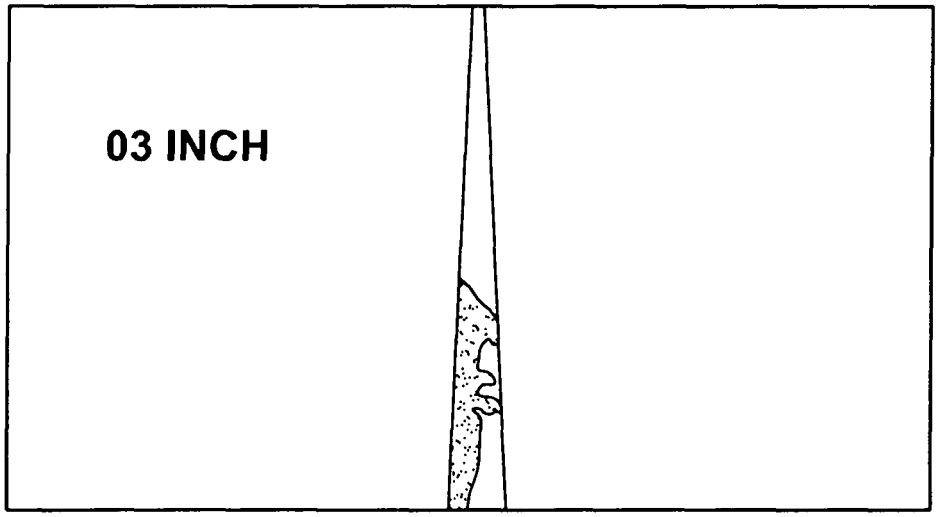
FIG. 5Hii

FIRE UNDER GLASS DISPLAY

CROSS REFERENCE TO RELATED APPLICATION

This application claims the benefit of U.S. Provisional Application No. 62/549,372, filed Aug. 23, 2017, the contents of which are incorporated herein by reference.

FIELD OF THE INVENTION

The current invention generally relates to displays and visual effects, including those involving fire.

BACKGROUND OF THE INVENTION

Displays that include fire for visual effects have existed for some time. For example, there are water fountains that include devices that launch fire into the air along with the water streams. There are also pyrotechnic fire displays used with music concerts, Fourth of July celebrations and other events.

However, many existing fire displays exist strictly above the ground and therefore have limitations and other shortcomings.

As such, there continues to be a need for new and innovative fire displays that introduce new variables into the display to provide enhanced visual effects. For example, there is a need for a fire display wherein the display may contain fire that may be below the surface of a floor or the ground, or otherwise removed from the observer.

SUMMARY OF THE INVENTION

In a first aspect of the invention, a display with fire is described where fire that may travel along a tray beneath a transparent floor or panel. The fire display may generally comprise an assembly below the floor, including a metal tray, a fire delivery assembly and a top plate. The top plate may comprise a section of the floor. Flammable gas may generally be injected into the front end of the tray and be ignited by a pilot light to create a fire cloud that may then continue to travel the length of the tray. As such, a display of a fire cloud traveling a length of the floor is provided.

Additional flammable may exist such that the resulting fire cloud may continue to combust as it travels down the tray. The top plate may be transparent and may seal the tray and the fire cloud within while allowing viewers from above to enjoy the visual effects of the shooting fire.

In alternative embodiments, the current invention may reside in walls, ceilings, roofs or other sections of buildings where a fire display may be desired. In these embodiments, for example, wall section, ceiling section, etc., may be transparent.

In another aspect of the invention, the tray may include a gas manifold that may supply additional oxygen or flammable gas to the fire cloud as it travels the length of tray. In this manner, the fire cloud's travel distance may be extended and/or enhanced.

In another aspect of the invention, the display may have viewing windows or slots that may have different widths. Where the viewing window resides in a floor, it is preferred that it comprise a durable material to enable people to walk on it, and to resist damage from, e.g., high-heeled shoes.

In another aspect of the invention, the tray may include a cooling manifold that may spray water onto the underneath side of the top plate to keep it cool and from overheating.

The water spray may also tend to clean any soot or other types of residue from the underside of the top plate that may accumulate during use.

In another aspect of the invention, multitude fire displays may be combined to form different shapes, or may be used with each other or with other display elements to complement each other and/or provide enhanced visual effects.

Another aspect of the invention involves the fire display being utilized within other types of displays such as within the reservoir of a water display.

Another aspect of the invention involves the fire display being utilized as visual signal for a doorbell, a ringing phone or other types of events or reminders. Alternatively, an audio component may be triggered when the fire cloud is shot.

Other aspects of the invention are discussed herein.

BRIEF DESCRIPTION OF THE DRAWINGS

FIGS. 5Gi, 5Gii and 5Giii are views of a top plate with a six inch viewing slot.

FIGS. 5Hi and 5Hii are views of a top plate with a three inch viewing slot.

DETAILED DESCRIPTION OF THE PREFERRED EMBODIMENTS

Figure 1A:
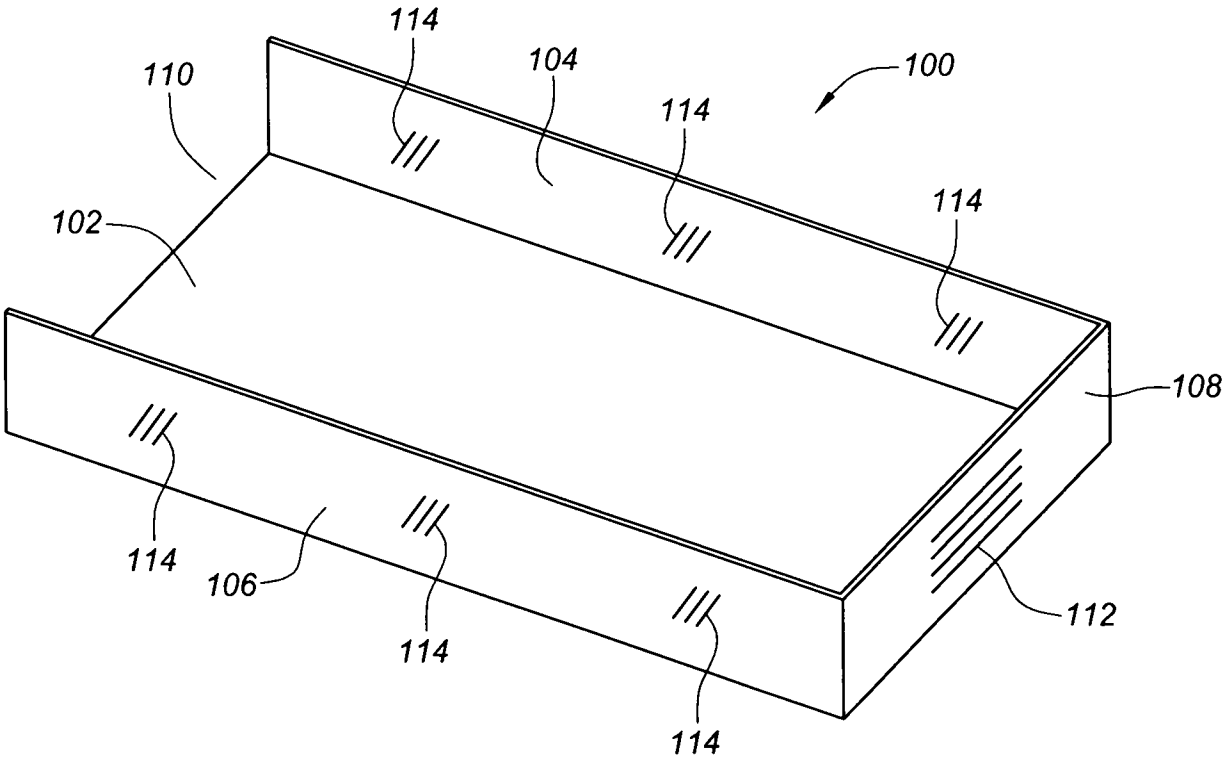
FIG. 1A is a perspective view of a tray.

The following detailed description is not intended to limit the current invention. Alternate embodiments and variations of the subject matter described herein will be apparent to those skilled in the art.

The display 10 of the current invention and the visual effects that it may produce are now described with reference to the figures. Where the same or similar components appear in more than one figure, they are identified by the same or similar reference numerals.

In general, display 10 provides dramatic visual effects by shooting fire along a channel, pan or tray that may be located beneath a transparent floor panel. Display 10 may be installed inside hotels, restaurants, public buildings or in atriums, lobbies or other indoor locations. Display 10 may also be installed in walls, ceilings, roofs or other sections of buildings or other locations. Display 10 may also be installed in outdoor spaces such as parks, amusement areas, outdoor dining or bars, poolside, plazas or in other types of outdoor spaces. As such, display 10 may provide an attraction to these buildings and spaces. Display 10 may also be included in existing fire, water and/or lighting displays to provide enhanced visual effects.

As shown in the figures, display 10 may include tray assembly 100, ignition or fire delivery assembly 200, top plate assembly 300 and cooling assembly 400. Additional components and/or assemblies may also be included as described in later sections.

In general, ignition or fire delivery assembly 200 may inject or provide pressurized flammable gas across a pilot light at one end of tray assembly 100 such that the gas may be ignited by the pilot light as it travels over and comes into contact with the flame of the pilot light. It is preferred that the pressurized flammable gas be released and directed in the direction the flame is to travel down tray assembly 100. Once ignited, and due to the pressure and direction that fire delivery assembly 200 may impart upon the gas, the ignited gas may travel the length of tray assembly 100 as a current, cloud, ball, wave or general mass of traveling fire.

Top plate assembly 300 may cover the top portion of tray assembly 100 and may comprise a glass plate, Plexiglas or other material of adequate thickness to support the weight of people who may walk upon the plate 300. The material chosen for top plate assembly may also exhibit low thermal conductivity to avoid or reduce the risk of burning observers. Being transparent, top plate 300 may allow patrons within eye sight of display 100 to witness the traveling fire wave along tray 100 from one end to the other.

Figure 1B:
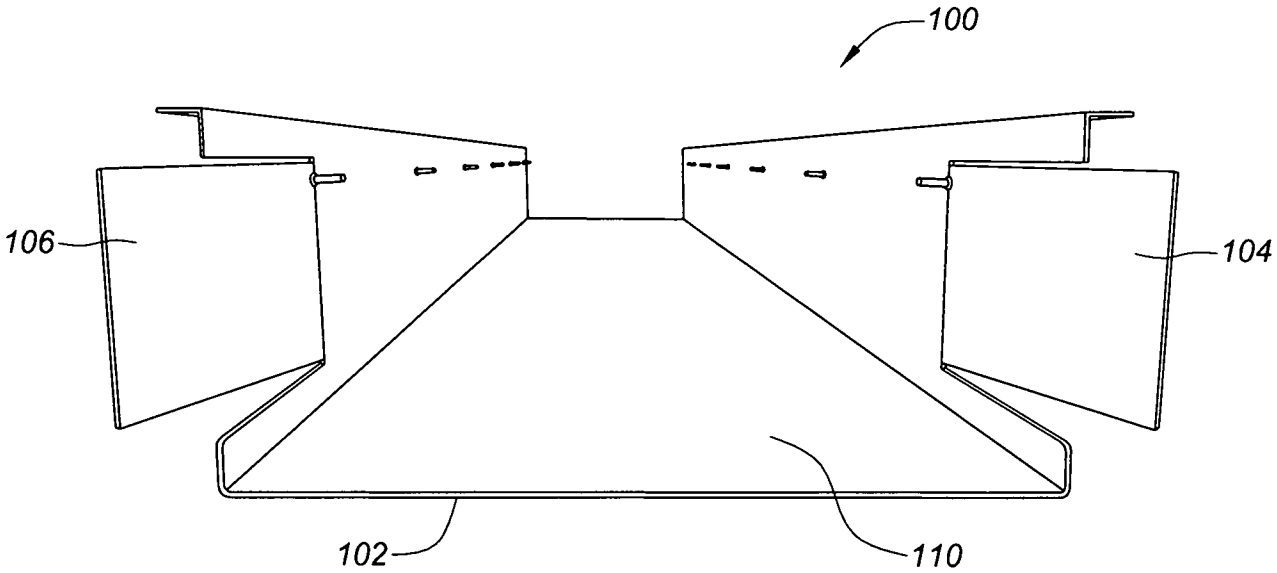
FIG. 1B is a front perspective view of a tray.
Figure 1C:
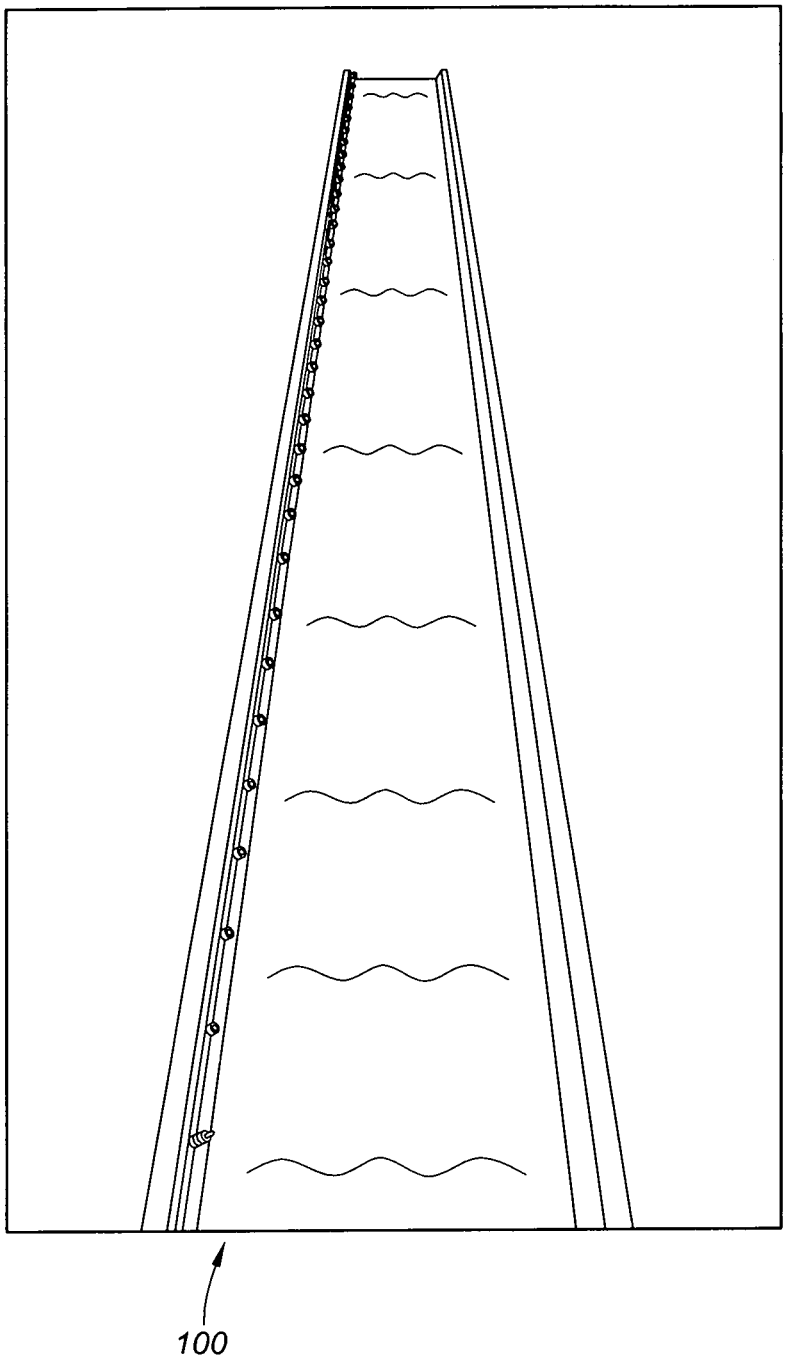
FIG. 1C is a top perspective view of a tray.

Referring now to FIGS. 1A, 1B and 1C, tray assembly 100 is described in further detail. Tray assembly 100 may generally resemble an open trough or tray and may include bottom 102, left side 104, right side 106, back end 108, front end 110 and a generally open top. Tray assembly 100 may be generally rectangular in shape but may also be formed in other shapes such as trapezoidal, square, circular or in other shapes or geometries. In addition, tray assembly 100 may be constructed out of metal or other fire retardant material, or may be coated with fire retardant paint or other type of coating that may protect it from the fire that it may contain during usage. Tray assembly 100 may also be formed from a single piece of material, or bottom 102, left side 104, right side 106 and back end 108 may be attached together to generally form tray assembly 100, with the various pieces welded, bolted, screwed, riveted or otherwise attached together in a way that preferably results with no gaps between the pieces.

The dimensions of tray assembly 100 may vary depending on the environment of the installation. For example, the tray may have a length of one to two feet, or may extend to eighteen feet in length or greater. The width of tray 100 may be less than an inch wide or may extend to 3 inches, 6 inches, 12 inches, 16 inches, 18 inches or wider. The depth of tray 100 may range from less than one inch to 6 inches, or to 12 inches or more. The dimensions of tray assembly 100 may be varied to alter the desired visual display.

As depicted in FIG. 1A, sides 104, 106 may be generally parallel with each other such that tray 100 is rectangular. However, sides 104 106 may also taper towards or away from each other such that the general shape of tray 100 may be trapezoidal. In addition, sides 104, 106 may be generally straight or may curve or bend such that tray 100 may form different shapes such as a zigzag, a wave, a wiggle, a loop, a curve or other types of shapes.

Back end 108 of tray 100 may be generally closed and may include an exhaust duct 112 that may allow for the adequate ventilation of the traveling fire wave, including any ignited gas, any unburned flammable gas, smoke, soot or other elements that may exist as the fire wave reaches the back end 108 of the tray 100. Alternatively, if back end 108 is generally closed, it may include an exhaust duct 112 that may allow for the adequate ventilation of the products of combustion as described above. The front end 110 of the tray may be configured with fire delivery assembly 200 as will be described next.

FIG. 1B depicts tray 100 from the view of looking into the front end 110 while FIG. 1C depicts tray 100 from above. Though tray 100 is depicted as rectangular, other forms may be used.

Figure 2A:
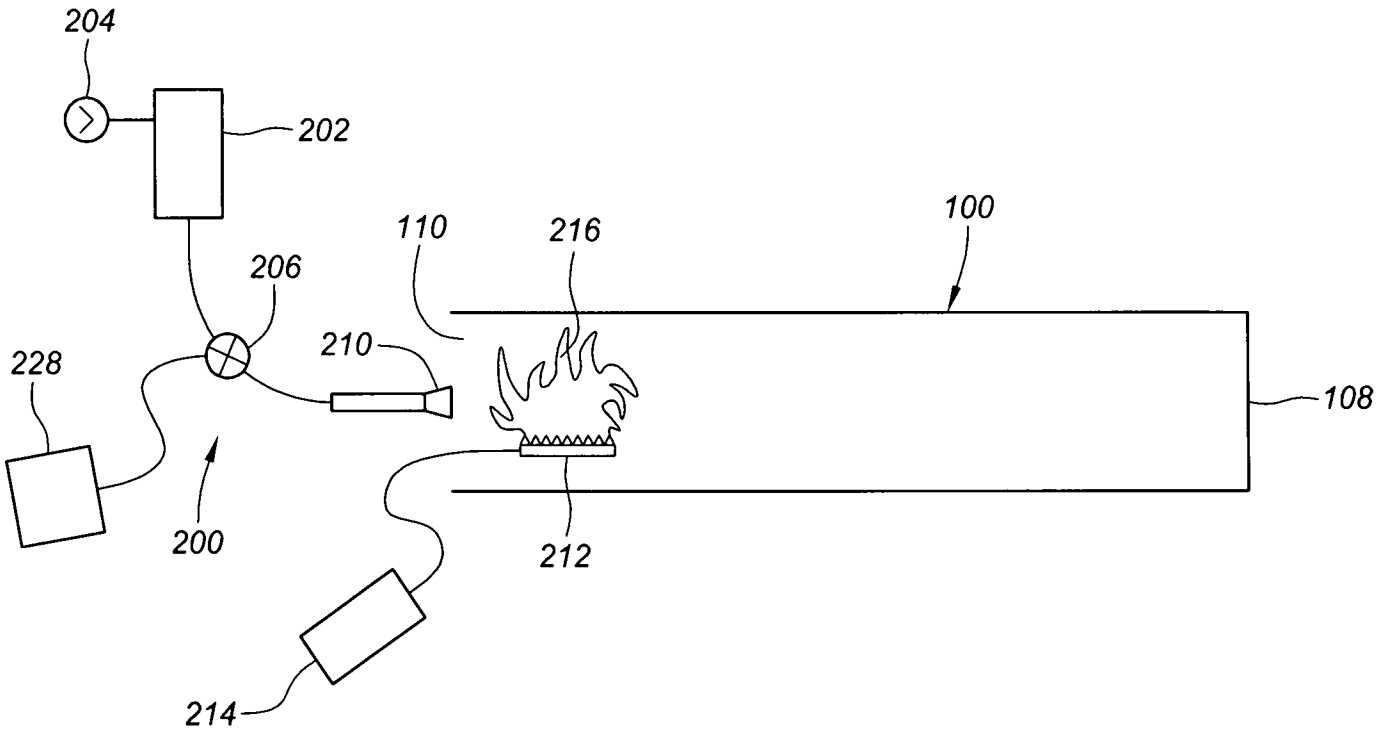
FIG. 2A is a side section view of a tray and a fire delivery assembly.
Figure 2B:
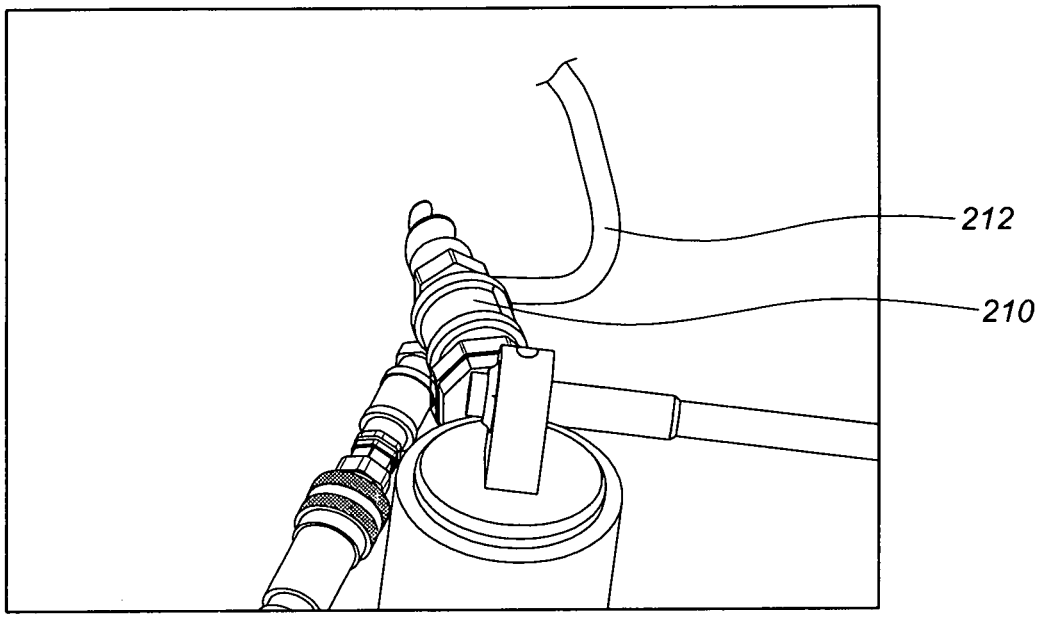
FIG. 2B is a top perspective view of a gas nozzle and a pilot light.
Figure 2C:
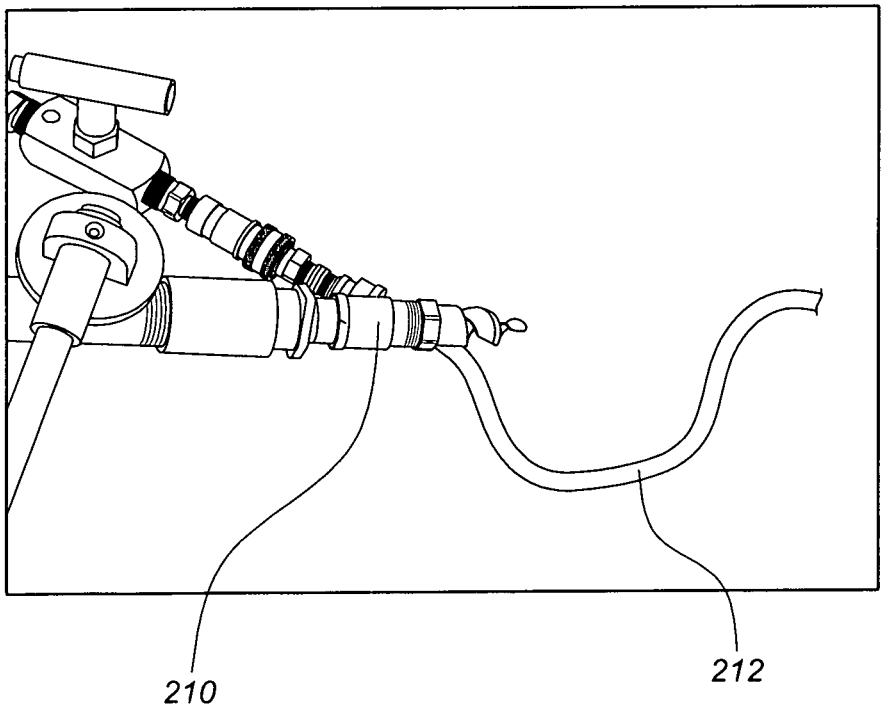
FIG. 2C is a top perspective view of a gas nozzle and a pilot light.

As depicted in FIGS. 2A, 2B and 2C, fire delivery assembly 200 may comprise pressurized flammable gas that may be contained in gas pressure tank 202. The flammable gas may be available directly from another supply such as from the building's gas supply such that gas tank 202 may not be necessary. The flammable gas may include propane, butane, methane, ethylene, hydrogen, acetylene, ammonia, ethane, or any other type of flammable gas that may adequately ignite.

Fire delivery assembly 200 may also include gas pressure gage 204, gas valve 206, gas tubing 208 and gas nozzle 210. As depicted, gas tubing 208 may extend from gas pressure tank 202 to gas pressure valve 206 and from there to gas nozzle 210 such that flammable gas within gas pressure tank 202 may travel through gas tubing 208 from the tank 202, through the valve 206 and out the nozzle 210. Flammable gas within gas pressure tank 202 may be kept at a high enough pressure such that as it is released by gas valve 206 and out nozzle 210, it is directed to and travels across ignition source 212 with enough velocity that as it ignites, the resulting burning fire wave, ball or current may travel the length of tray 100 from front end 110 to back end 108. This will be described in greater detail in later sections. Ignition source 212 may be a pilot light, a flame or series of flames, a burner, a spark, a hot surface, or any other type of ignition source.

The pressure of the flammable gas within gas tank 202 may be identified by pressure gage 204 configured with gas tank 202 such that the tank pressure is known and maintained at a safe level and at an adequate pressure for usage. As gas is exhausted from tank 202, gas from an outside source may be introduced to replenish the gas and its pressure in tank 202.

Gas valve 206 may control the flow of flammable gas from pressurized gas tank 202 through gas tubing 208 and out gas nozzle 210, and may be a manual valve or may be an electrically operated automatic valve that may be controlled by controller 224 or other type of control device. The control of valve 206 may be coordinated with the control of other effects such as an audio swooshing gas sound that may emanate from nearby speakers as the fire wave travels down tray 100.

Ignition source 212 may be generally configured in front of gas nozzle 210 such that flammable gas that may be emitted by nozzle 210 may travel across ignition source 212 and be ignited. Accordingly, ignition source 212 may be configured one inch to six inches or even twelve inches or more in front of gas nozzle 210 and may be generally in-line with the path of the emitted gas. Ignition source 212 may comprise a multiple of individual flames, a series of flames or a single flame. Ignition source 212 may also include its own gas supply tank 214 as depicted by FIG. 2A, may utilize gas from pressurized gas tank 202 or may receive flammable gas to ignite its pilot flames from another gas source. FIGS. 2B and 2C depict ignition source 212 as a loop or in the shape of a Y, and that other shapes may be used. These types of shapes may optimize the ignition of fire cloud 216. The distance between nozzle 210 and ignition source 212 may be varied so that the spray, mist or other form of the emitted gas is at a desired density upon ignition.

To create the visual effect of display 100, gas valve 206 may be controlled to open to allow a high pressure burst of flammable gas to be released from pressurized gas tank 202 such that the gas may be emitted out of gas nozzle 210 and into tray 100 at a relatively high pressure and velocity. For example, the gas may be emitted at 2 psi, 10 psi, 20 psi or higher depending on the width and length of tray 100. As the gas travels across the flames of ignition source 212, a portion of the gas may ignite to create a forward moving fire wave 216, fire ball, fire current or other type of traveling fire mass that may have enough residual forward velocity to continue traveling the length of tray 100.

Alternatively, an excess amount of gas may be released at high pressure such that not all of the gas is initially ignited by ignition source 212. Instead, the excess amount of flammable gas may then travel the length of tray 100 along with the traveling fire cloud 216. This way, the excess gas may be used to continually fuel fire cloud 216 along the length of tray 100. That is, fire cloud 216 may continually ignite the excess gas as it travels down tray 100 such that fire cloud 216 remains burning the entire length of the tray 100. Thus, the visual effect is that of a fire wave 216 traveling across the tray 100 from one end to the other.

It should also be noted that the flammable gas may be released into tray 100 at a lower pressure, or even at atmosphere pressure, and then pushed over ignition source 212 and down tray 100 through the use of blowers, fans or other mechanisms that may push the flammable gas cloud forward.

Figures 3A, 3B, 3C, 3D:
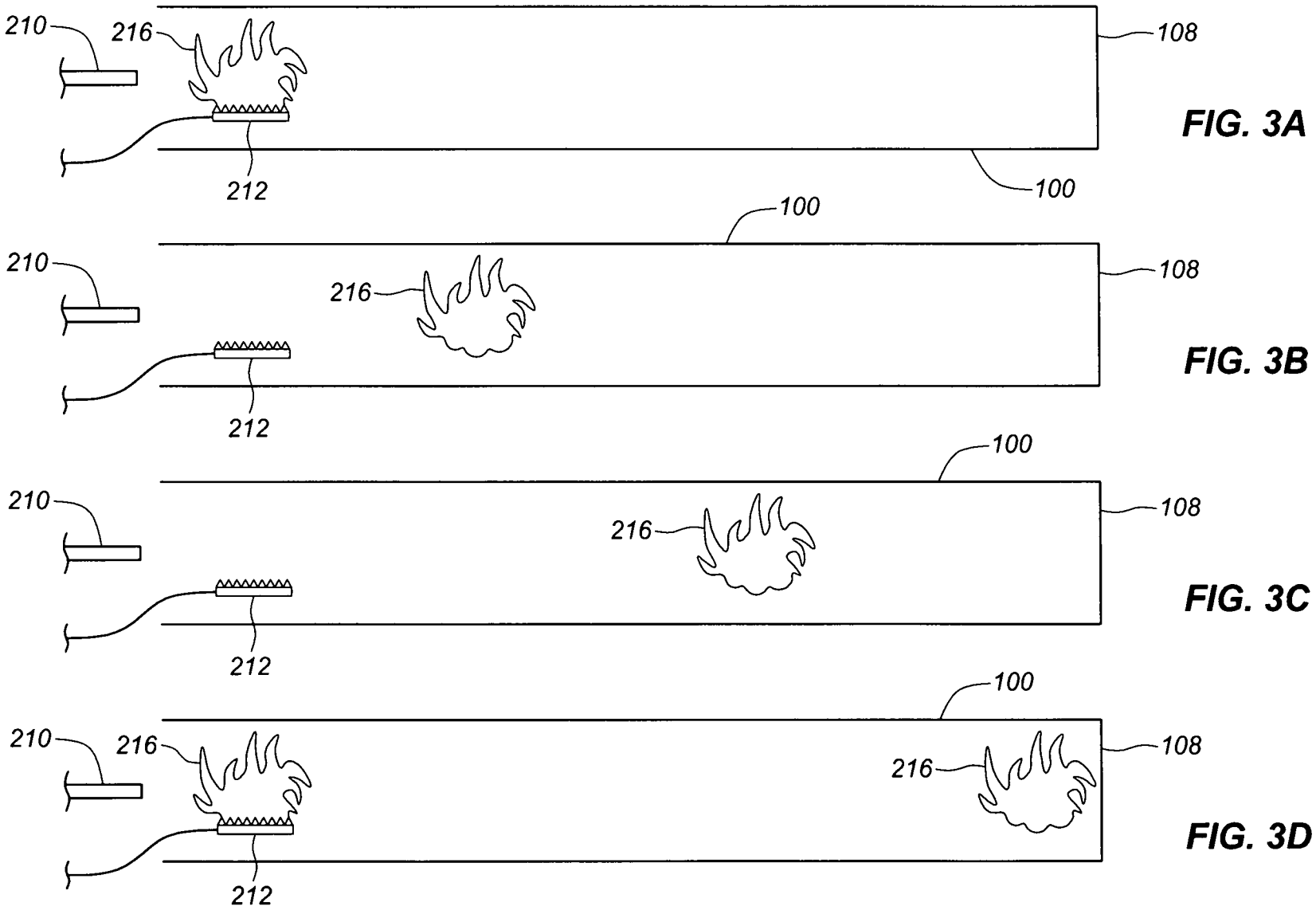
FIGS. 3A-3D are side section views of a tray with a fire cloud in different positions as it travels the length of the tray.

FIGS. 3A-3D depict fire cloud 216 at different positions along tray 100. For example, FIG. 3A depicts fire cloud 216 as it may be first be ignited by ignition source 212. FIG. 3B depicts fire cloud 216 a moment later as it continues its forward trajectory along tray 100. FIG. 3C depicts fire cloud 216 further along tray 100 and FIG. 3D depicts fire cloud 216 as it reaches the back end 108 of tray 100. While fire cloud 216 is depicted as a fire cloud 216 or ball that may generally maintain a particular form as it travels the length of tray 100, the form of fire cloud 216 may vary and may be elongated, shrunken, generally dispersed or may form any other shape or form as it generally travels the length of tray 100. In addition, as the currents of fire and gas travel down tray 100, the fire may swirl, tumble, resemble a vortex or flow in wisps or other shapes or forms as it moves. This is also represented in FIGS. 5D-5H described in later sections.

The amount of gas released by gas nozzle 210 may depend on the pressure of the gas within pressurized gas tank 202 and the amount of time that gas valve 206 may be open. The size and percentage open of the aperture within gas valve 210 during the release of the gas may also determine the amount of gas released. In any event, the amount of gas released by nozzle 210 is preferably enough to create a fire wave 216 that may generally fill the width of tray 100 at front end 110 and continually burn as it travels to back end 108. In order to achieve this, valve 206 may be opened for only a second or two in order to release a quick burst of gas, or it may be opened for longer in order to release a larger burst of gas.

As fire cloud 216 travels along the length of tray 100 while continuing to burn the excess gas as described above, it may also require additional oxygen in order to continue to combust. Because tray 100 may be a fixed volume, the amount of air, and therefore oxygen, within tray 100 may be limited and may not be sufficient to allow fire cloud to continue to combust the entire length of the tray 100. Accordingly, tray 100 may also include open air vents 114 located on sides 104, 106 as depicted in FIG. 1.

Open air vents 114 may allow additional air to draft into tray 100 to provide the oxygen that may be necessary for fire cloud 116 to continue to combust as it travels the length of the tray 100. Open air vents may be positioned in a periodic fashion or in a series along the walls 104, 106 or may be positioned in any configuration that may adequately provide the additional oxygen necessary. Open air vents may also be configured with bottom 102 or with any other sides of tray 100.

Figure 4:
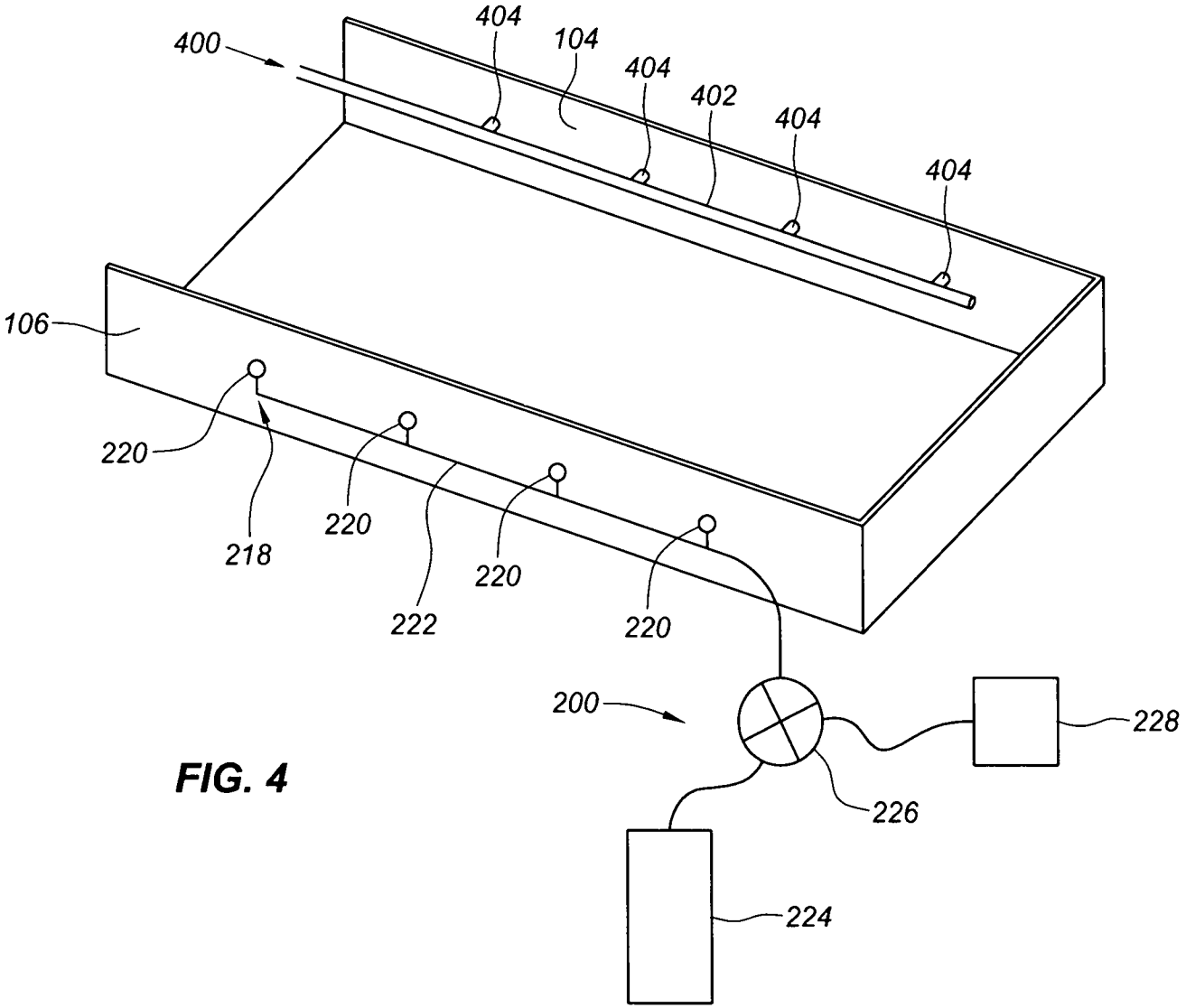
FIG. 4 is a perspective view of a tray with a gas manifold and a water cooling manifold.

In another embodiment as shown in FIG. 4, tray 100 may also include gas manifold 218 that may provide additional oxygen or combustible gas to tray 100. Gas manifold 218 may include gas orifices 220 that may be configured with side walls 104, 106 of tray to inject or otherwise provide gas into tray 100 through one or more orifice(s) 220. Gas line 222 that may provide the gas from gas tank 224 through gas valve 226 to gas orifices 220. Gas valve 226 may control the flow of gas from gas tank 224 through gas line 222 and out gas orifices 220, and may be a manual valve or may be an electrically operated automatic valve that may be controlled by a controller 228 or other type of control device.

While FIG. 4 depicts gas manifold 218 as being generally positioned on the outside of wall 106 of tray 100 with orifices 220 penetrating from the outside to the inside of tray 100 to provide gas into the tray 100, gas manifold 218 may be positioned inside on the inner surface of wall 106 such that manifold 218 may release gas directly into the tray 100 from its position on the inner sides of walls 104, 106. Gas manifold 218 may also be positioned in other configurations and locations outside and/or within tray 100.

In one embodiment of display 10 that may utilize gas manifold 218, gas manifold 218 may provide oxygen to tray 100 through gas orifices 220. This injected oxygen may enrich the oxygen content within tray 100 so that fire cloud 216 has enough oxygen necessary to continue to combust as it travels the length of tray 100. The release of the oxygen into tray 100 may be timed to coincide with the position of the fire cloud 216 and may be controlled by controller 228. For example, downstream orifices may be controlled to provide air at a time calculated when fire cloud 216 passes by.

In addition, while FIG. 4 depicts a single gas valve 226 that may release gas to all of the gas orifices 220, each gas orifice 220 or different groups of orifices 220 may include their own dedicated control valve to release gas into those particular orifices 220. Accordingly, with gas manifold configured to provide additional oxygen to tray 100, it addresses any deficiency of oxygen within tray 100 during operation of display 10. This may be necessary for longer trays, for example, for trays 100 that may exceed eighteen feet in length. In this scenario, gas tank 224 may contain oxygen.

In another embodiment of this type, gas manifold 218 may provide flammable gas to tray 100 through gas orifices 220. This additional flammable gas may provide additional fuel to traveling fire cloud 216 as it travels the length of tray 100 so that it may continue to combust the entire length of the tray. The release of the flammable gas into tray 100 may be timed to coincide with the position of the fire cloud 216 and may be controlled by controller 228.

In addition, while FIG. 4 depicts a single gas valve 226 that may release gas to all of the gas orifices 220, each gas orifice 220 or different groups of orifices 220 may include their own dedicated control valve to release gas into those particular orifices 220. Accordingly, with gas manifold configured to provide additional flammable gas to tray 100, it addresses any deficiency of excess flammable gas within tray 100 during operation of display 10. This may be necessary for longer trays 100, for example, for trays 100 that may exceed eighteen feet in length. In this scenario, gas tank 224 may contain a flammable gas. In addition, in this scenario, gas manifold 218 may be configured with gas tank 202.

Figure 5A:
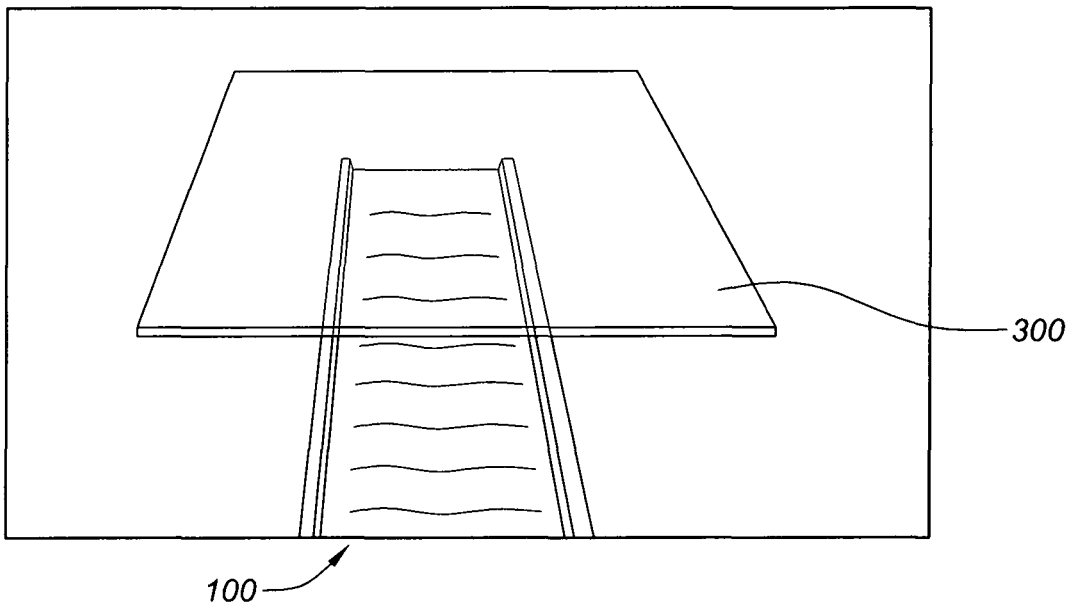
FIG. 5A is a view of a top plate being placed on a tray.
Figure 5B:
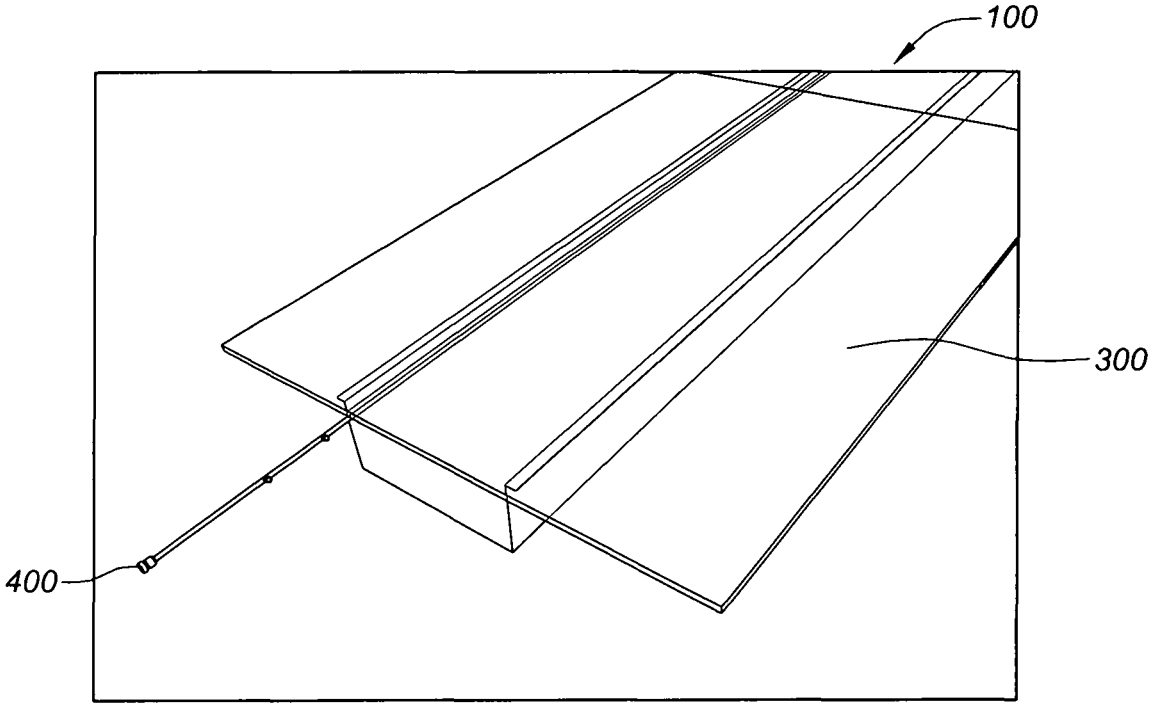
FIG. 5B is a top view of a top plate in place on top of a tray.

Top plate assembly 300 will now be described in detail. Top plate assembly 300 may comprise a plate of transparent glass, Polycarbonate or other generally transparent material that may cover and generally seal the top of tray 100 while allowing visibility of the fire cloud 216 within. Top plate 300 is preferably fireproof and heat resistant. FIG. 5A depicts top plate 300 being positioned onto the top of tray 100 and FIG. 5B depicts top plate 300 generally in place. In addition, top plate 300 may be sufficiently thick and strong enough to withstand weight to be placed on the top plate 300 without it cracking, shattering or otherwise breaking. It is preferred that top plate 300 may withstand an amount of weight equivalent to a large number of people standing on top plate while viewing the fire cloud 216 within the tray 100.

Top plate 300 is also preferably sufficiently rugged so that it may withstand pounding, stomping, jumping or other forces that may result from people walking, running, jumping or otherwise applying a significant amount of force to top plate 300. Also, top plate 300 may be strong enough to withstand being chipped, scratched or dented from hard objects that may dropped onto top plate 300, or from hard heels that may be on the bottom of viewers' shoes or boots that may tend to pound onto the top plate 300.

Figure 5C:
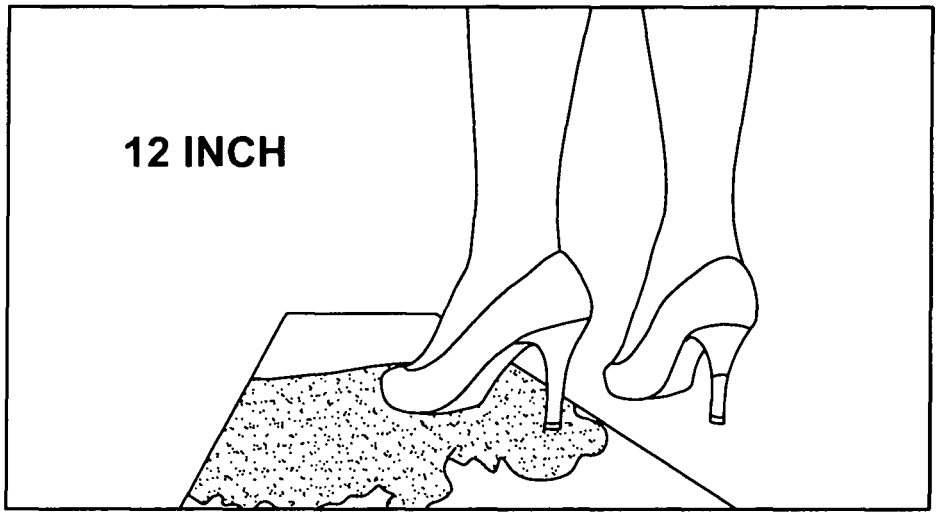
FIG. 5C is a view of a person standing on a top plate.

For example FIG. 5C depicts a woman standing on top plate 300 while wearing a pair of high heels shoes that may include a sharp heel while top plate 300 is unharmed and easily withstanding the applied weight. In general, top plate 300 may be able to withstand any force that may be applied to it during general use such that it may not break. While top plate 300 has been described as being generally transparent, top plate 300 may be opaque, tinted, colored, smoked or may have other textures or colorations.

In addition, top plate 300 may be heat resistant in order to withstand the heat that may be generated by fire cloud 216 so that it may not melt, deform or otherwise become adversely affected by the heat and combustion. For example, top plate 300 may comprise glass, heat resistant thermoplastic materials or other heat resistant materials. Top plate 300 may also comprise layers of different materials such as plastic over glass or other types of layered materials. For example, top plate 300 may have a heat resistant layer in contact with the fire cloud 216 and a durable layer on top to withstand foot traffic. Other types of layers of different types of materials may also be used.

It should be noted that top plate 300 may be flush with the other floor paneling that may surround display 10 such that there are no steps, uneven surfaces, grooves or other types of disjunctions between top plate 300 and the surrounding floor. Plate 300 may also comprise a wall panel, ceiling panel or other viewing panel. In general, it is preferred that panel 300 allow the display to be observed and also keeps the observers safe from the fire.

Top plate assembly 300 may also include a viewing window or slot 302 that may define the edges of the viewing window. For instance, it may be preferable for the edges of the tray to be masked so that viewers from above may not see sides 104, 106 and any components that may be configured with the sides 104, 106 (such components will be described in later sections). Accordingly, top plate assembly 300 may include covers that may be aligned to form the viewing slot 302 that may mask sides 104, 106 of tray 100. That is, the covers may extend over the edges of the tray 100 such that the tray 100 is wider than the viewing slot 302. Or, the surrounding floor may extend over sides 104, 106 such that the surrounding floor may mask the sides 104, 106. Other types of panels, covers, flooring or mats may also be used.

Figure 5D:
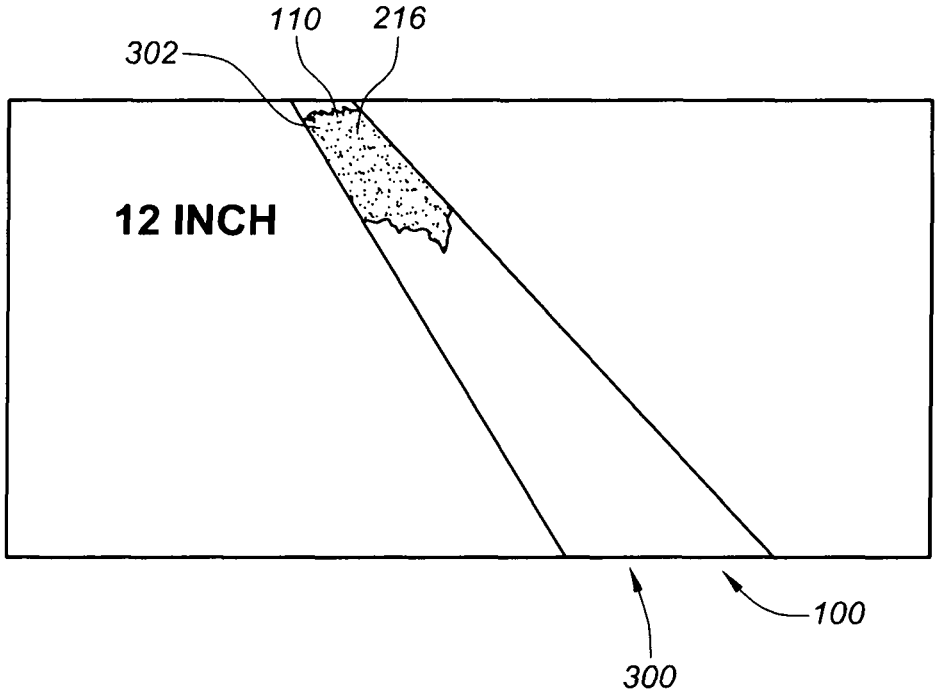
FIG. 5D is a view of a top plate with a twelve inch viewing slot.
Figure 5E:
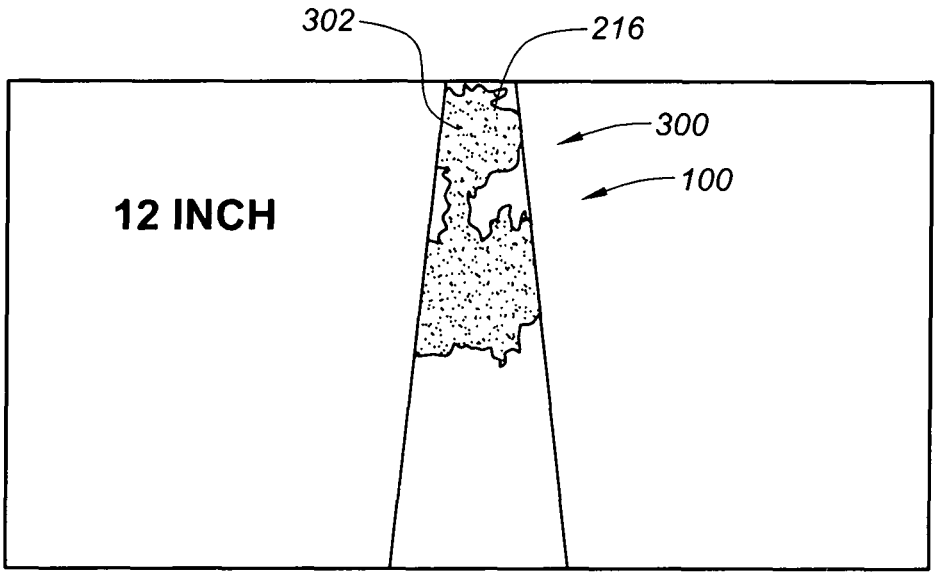
FIG. 5E is a view of a top plate with a twelve inch viewing slot.
Figure 5F:
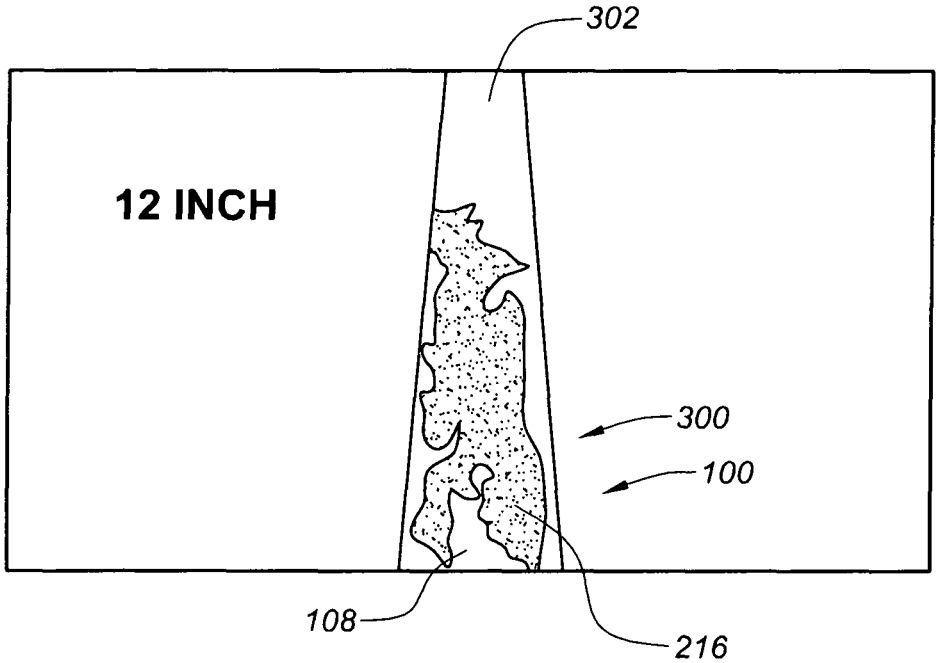
FIG. 5F is a view of a top plate with a twelve inch viewing slot.

Dimensions of the viewing slot 302 may vary. Its width may range from less than one inch to three inches, to 6 inches, to twelve inches and larger. For example, FIG. 5D depicts fire cloud 216 generally at the front end 110 of tray 100 with a top plate 300 and a viewing slot 302 of twelve inches wide. FIG. 5E depicts top plate 300 with the same twelve inch viewing slot 302 with the fire cloud 216 moving toward the center region of tray 100. And FIG. 5F depicts the same twelve inch viewing slot 302 with fire cloud 216 reaching the rear section 108 of tray 100. In other examples, FIG. 5G depicts a viewing slot 302 of six inches and FIG. 5H depicts a viewing slot 302 of three inches.

In addition, display 10 may include cooling assembly 400 that may comprise water spray manifolds 402 that may be configured with side wall 104, with side wall 106 or with both side walls 104, 106 within tray 100 as shown in FIGS. 4 and 5B. Water spray manifolds 402 may comprise water sprayers 404 that may spray water onto the underside surface of top plate 300 when top plate 300 is configured to comprise the top of tray 100. The positioning of each water sprayer 404 may be such that adequate water coverage is achieved and that all necessary areas of the underside of top plate 300 may be sprayed with water.

In this way, several benefits may be accomplished. For example, the water released by water sprayers 404 onto the underside of top plate 300 may cool top plate 300 if it may be heated by fire cloud 216. This may eliminate any danger of viewers positioned on top of top plate 300 being burned or uncomfortably heated in any way. In addition, cooling top plate 300 may also protect it from damage from the heat of fire cloud 216 which may otherwise tend to scorch the underside of top plate 300. Also, heat may also tend to cause materials to become brittle or less rugged and the cooling of top plate 300 may eliminate this danger as well.

The spraying of water onto the underside of top plate 300 by water spray manifold 402 may also clean plate 300. In this way, soot, carbon or other types of residue that may be left by fire cloud 216 on the underside of top plate 300 may be cleaned such that the transparent nature of top plate 300 may be maintained for optimal viewing of display 10.

In another embodiment of display 10, multiple trays 100 may be utilized simultaneously. These multiple trays 100 may be configured together to form a variety of shapes such as a cross, a T-shape, or other types of shapes such that the fire clouds 216 within the combined trays 100 may flow through the various shapes. In addition, the trays 100 may not be combined but instead may run parallel to each other or at different angles to each other to form a wide variety of geometrical shapes and designs. Trays 100 may also be formed into the walls or ceiling of a building or room, and may even comprise the entire floor, walls and/or ceiling of the building or room. Trays 100 and associated fire clouds 216 may also be combined with other visual effects such as strobe lights, colored lighting, black light, and other types of visual effects.

In addition, the fire cloud(s) 216 within one or more trays 100 may be sequenced and choreographed to coincide with other display elements such as music, a lighting show, or other types of elements. Display 10 may also be incorporated into other types of displays such as with water fountains where the trays 100 may be configured with the reservoir floors or with other elements or in other locations within the water displays.

Display 10 may also be utilized as other types of attention-getting events such as the signaling of a doorbell, an alarm, the ringing of a phone or other types of reminders or events.

Although certain presently preferred embodiments of the invention have been described herein, it will be apparent to those skilled in the art to which the invention pertains that variations and modifications of the described embodiments may be made without departing from the spirit and scope of the invention.

What is claimed is:

1. A display, comprising:

a tray having a first end and a second end;

an oxygen delivery system;

a fire delivery system that is located at or adjacent to the first end, or between the first end and the second end, and that provides flammable gas that is ignited by an ignition source to create fire that is directed along the tray toward the second end;

a top plate that is coupled to the tray, that seals the tray and that allows an observer to view the fire as the fire travels along the tray; and an exhaust system.

2. The display of claim 1, wherein the tray is located beneath a floor and the top plate comprises part of the floor.

3. The display of claim 1, wherein the top plate comprises glass.

4. The display of claim 1, further comprising a cooling assembly configured to cool the top plate.

5. The display of claim 1, wherein the fire delivery system includes a nozzle that directs the flammable gas across the ignition source with enough velocity so that as the flammable gas ignites, the resulting fire travels towards the second end.

6. The display of claim 5, wherein the resulting fire travels the length of the tray.

7. The display of claim 5, wherein the fire delivery system includes a pressurized gas tank that provides flammable gas to the nozzle.

8. The display of claim 7, wherein the fire delivery system includes a gas valve that is located between the pressurized gas tank and the nozzle, and that controls the release of flammable gas to the nozzle.

9. The display of claim 8, wherein the gas valve coordinates the release of flammable gas to the nozzle with another effect of the display.

10. The display of claim 9, wherein the other effect is an audio effect.

11. The display of claim 1, wherein the ignition source comprises a pilot light, a flame, a series of flames, a burner, a spark or a hot surface.

12. The display of claim 1, wherein the tray is located behind a wall and the top plate comprises part of the wall.

13. The display of claim 1, wherein the oxygen delivery system is incorporated into the fire delivery system.

14. The display of claim 13, wherein the fire delivery system provides flammable gas and oxygen.

15. The display of claim 1, wherein the oxygen delivery system includes one or more vents located in the tray.

16. The display of claim 1, further comprising a manifold that provides oxygen or flammable gas to the tray to assist directing the fire to the second end.

17. A fire display, comprising:

a tray having a first end and a second end and an open top or side;

an ignition source located at or adjacent to the first end, or between the first end and the second end;

a volume of oxygen or air contained in the tray;

a fire delivery system that is located at or adjacent to the first end, or between the first end and the second end, and that provides flammable gas that is ignited along with the volume of oxygen or air by the ignition source to create fire that is directed along the tray toward the second end;

a top or side plate that is coupled to the tray, that seals the open top or side and that allows an observer to view the fire as the fire travels along the tray; and an exhaust.

18. The fire display of claim 17, further comprising one or more vents in the tray that provide the volume of oxygen or air.

19. The fire display of claim 17, further comprising a manifold that provides oxygen or flammable gas to the tray to assist directing the fire to the second end.

20. The fire display of claim 17, wherein the top or side plate comprises part of a floor or a wall.

* * * * *